US007852187B2

(12) United States Patent
Yeh

(10) Patent No.: US 7,852,187 B2
(45) Date of Patent: Dec. 14, 2010

(54) COMPACT ELECTROMAGNETIC COMPONENT AND MULTILAYER WINDING THEREOF

(75) Inventor: Kuo-Chu Yeh, Tamshui Chen (TW)

(73) Assignee: Acbel Polytech Inc., Taipei Hsien (TW)

( * ) Notice: Subject to any disclaimer, the term of this patent is extended or adjusted under 35 U.S.C. 154(b) by 0 days.

(21) Appl. No.: 12/461,041

(22) Filed: Jul. 30, 2009

(65) Prior Publication Data

US 2010/0253465 A1 Oct. 7, 2010

(30) Foreign Application Priority Data

Apr. 6, 2009 (TW) ..... 98111337 A

(51) Int. Cl.
*H01F 5/00* (2006.01)

(52) U.S. Cl. ..... 336/200; 336/223; 336/232

(58) Field of Classification Search ..... 336/200, 336/223, 232

See application file for complete search history.

(56) References Cited

U.S. PATENT DOCUMENTS

| | | | | |
|---|---|---|---|---|
| 4,689,594 | A * | 8/1987 | Kawabata et al. | 336/200 |
| 5,032,815 | A * | 7/1991 | Kobayashi et al. | 336/83 |
| 6,774,757 | B2 * | 8/2004 | Fujiyoshi et al. | 336/200 |
| 6,980,074 | B1 * | 12/2005 | Jitaru | 336/200 |
| 7,453,344 | B2 * | 11/2008 | Maeda et al. | 336/200 |
| 7,460,002 | B2 * | 12/2008 | Estrov | 336/200 |
| 2007/0176722 | A1 * | 8/2007 | Podlisk et al. | 336/200 |

* cited by examiner

*Primary Examiner*—Anh T Mai
(74) *Attorney, Agent, or Firm*—Bacon & Thomas, PLLC

(57) ABSTRACT

An electromagnetic component has a multilayer winding. The multilayer winding has a stack body. The stack body has multiple sub-stacks and at least one second metal ring, each of which is interposed between two adjacent sub-stacks of the stack body. Each sub-stack has identical upper and lower first metal rings. Further, each second metal ring has identical upper and lower half rings. Therefore, the multilayer winding only uses two forms of the metal rings, so manufacturing costs will be decreased.

18 Claims, 15 Drawing Sheets

COMPACT ELECTROMAGNETIC COMPONENT AND MULTILAYER WINDING THEREOF

BACKGROUND OF THE INVENTION

1. Field of the Invention

The present invention relates to an electromagnetic component, and more particularly to a compact electromagnetic component and a multilayer winding thereof having two forms of multiple metal rings.

2. Description of Related Art

Electromagnetic components may be an inductor, a choke, a transformer or the like and has a coil. A conventional method of fabricating the coil is winding an enamel wire around a core. However, the electromagnetic component fabricated by winding has many limitations.

1. The size of the electromagnetic component is difficult to reduce and to provide a large power requires a large diameter enamel wire, large power electromagnetic components are bulky.

2. The electromagnetic component is not easily fabricated by automatic process so retaining high manufacturing costs.

Based on the above, a compact electromagnetic component is proposed. With reference to FIG. 13, a conventional folded foil transformer (90) construction has a primary winding (91) and a secondary winding (92).

The primary winding (91) is formed from a length of foil preferably wrapped in insulation and has a generally rectangular-shape with long planar segments (911), short planar segments (912) and corner turns defining a rectangular-shaped shaft. The secondary winding (92) has multiple U-shaped conductive sheets. The secondary segments (921) are preferably positioned adjacent to long planar segments (911) of the primary winding (91). Therefore, the electromagnetic component has low profile. However, since the primary winding (91) is fabricated by wrapping the length of foil, the corner turns are relatively weak.

With further reference to FIGS. 14 and 15A to 15C, another conventional compact electromagnetic component (90*a*) has a bobbin (93), a first annular winding pattern (941), a second annular winding pattern (942) and a semicircular winding pattern (943). The first annular winding pattern (941) has two connecting protrusions (941*a*, 941*b*) respectively having an enclosed and open mount and a first sector cutout (a). The second annular winding pattern (942) has two enclosed connecting protrusions (942*a*) and a second sector cutout (β). The semicircular winding pattern (943) has two enclosed connecting protrusions (943*a*, 943*b*). The bobbin (94) has multiple pins (941) corresponding to the connecting protrusions (941*a*, 941*b*) (942*a*, 942*b*) of the winding patterns (941, 942, 943). Therefore, the winding patterns (941, 942, 943) can be stacked on the bobbin (93). However, three different winding patterns must be fabricated by different molds and processes so has high manufacturing costs.

To overcome the shortcomings, the present invention provides a multilayer compact electromagnetic component to mitigate or obviate the aforementioned problems.

SUMMARY OF THE INVENTION

The main objective of the present invention is to provide a multilayer electromagnetic component and a multilayer winding thereof.

The multilayer winding has a stack body. The stack body has multiple sub-stacks and multiple second metal rings, each of which is interposed between two adjacent sub-stacks of the stack body. Each sub-stack has upper and lower first metal rings which are identical. Further, each second metal ring has upper and lower half rings which are identical. Therefore, the multilayer winding only uses two forms of metal rings, so tooling and manufacturing costs are decreased.

Other objectives, advantages and novel features of the invention will become more apparent from the following detailed description when taken in conjunction with the accompanying drawings.

DETAILED DESCRIPTION OF THE INVENTION

Figure 1A:
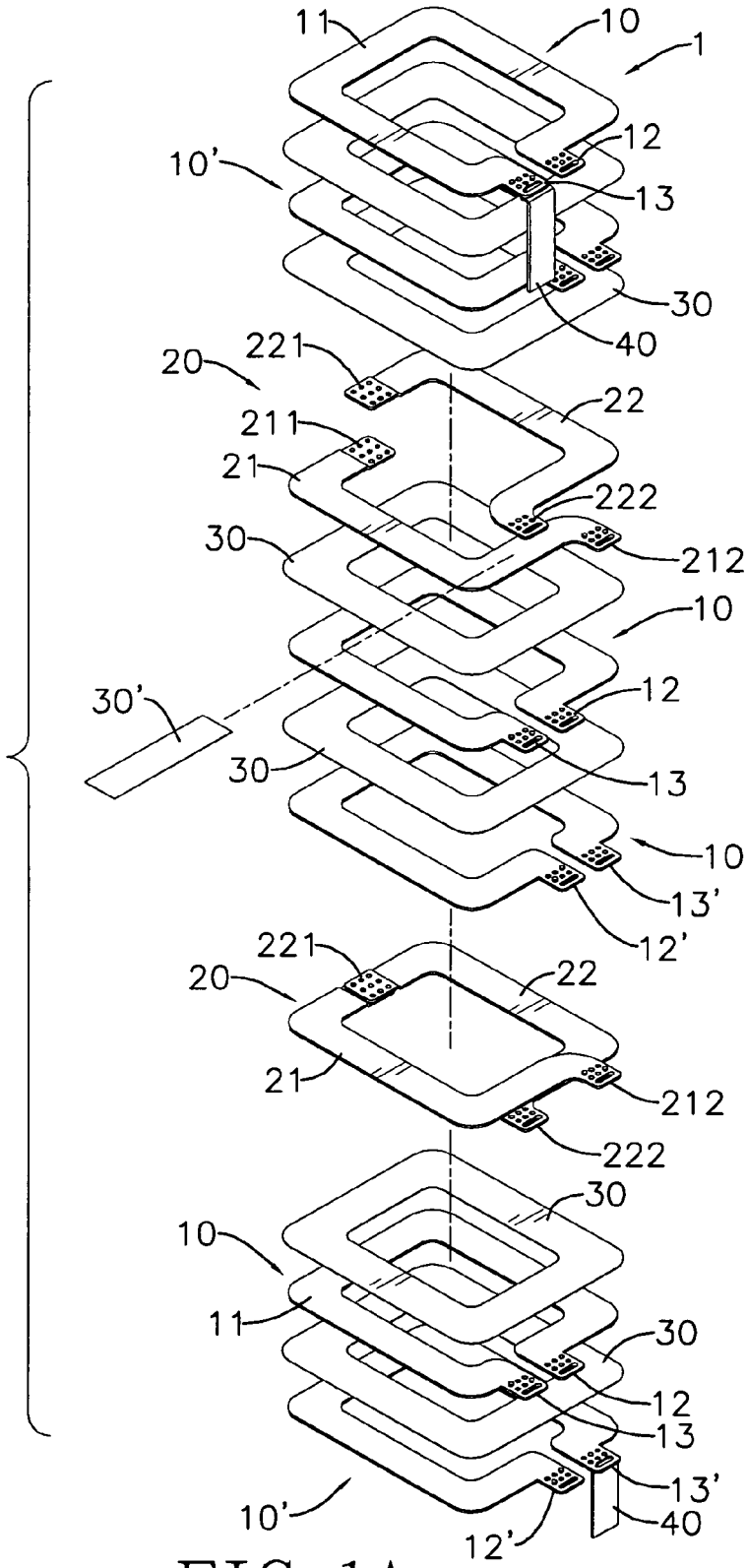
FIG. 1A is an exploded perspective view of a first embodiment of a multilayer winding in accordance with the present invention.

With reference to FIG. 1A, a first embodiment of a multilayer winding of an electromagnetic component in accordance with the present invention has a stack body (1) and first and second pins (40).

The stack body (1) has multiple sub-stacks (not numbered) and multiple second metal rings (20). The sub-stacks are stacked. Each second metal ring (20) is interposed between two corresponding adjacent sub-stacks through a first insulation layer (30). Each sub-stack has two adjacent first metal rings (10, 10') and the insulation layer (30). The insulation layer (30) is interposed between the two adjacent first metal rings (10, 10'). Therefore, when two adjacent sub-stacks are stacked, the second metal ring (20) is interposed between an upper first metal ring (10) of a lower sub-stack and a lower first metal ring (10') of an upper sub-stack through the insulation layers (30).

Figure 1B:
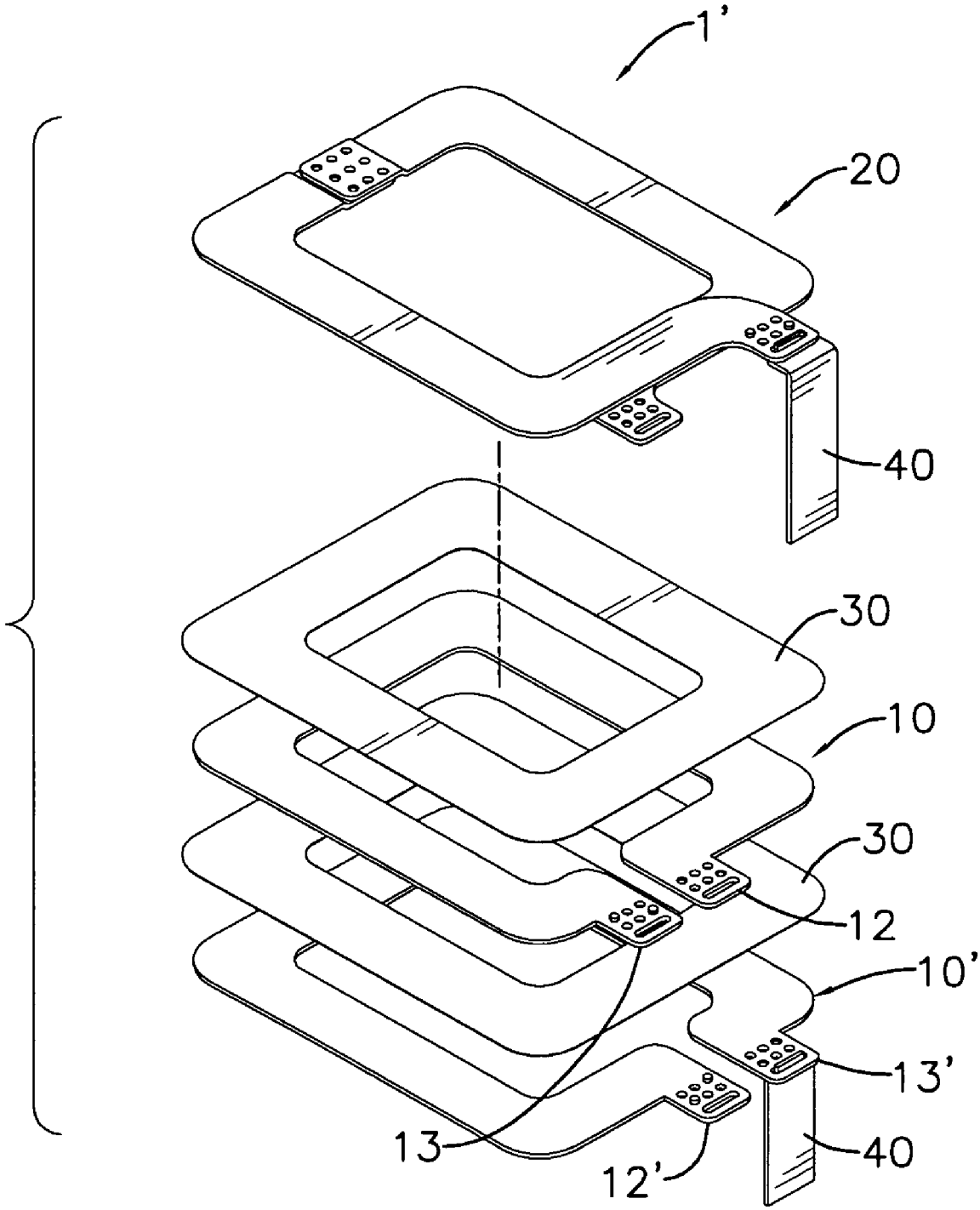
FIG. 1B is an exploded perspective view of a second embodiment of a multilayer winding in accordance with the present invention.

With reference to FIG. 1B, a second embodiment of a multilayer winding of an electromagnetic component is shown. A stack body (1') of the second embodiment has one sub-stack and one second metal ring (20) to form electromagnetic component having three coils. The metal ring (20) is stacked upon the sub-stack through the insulation layer (30). The pins are respectively connected to the sub-stack and the second metal ring (20).

Figure 2A:
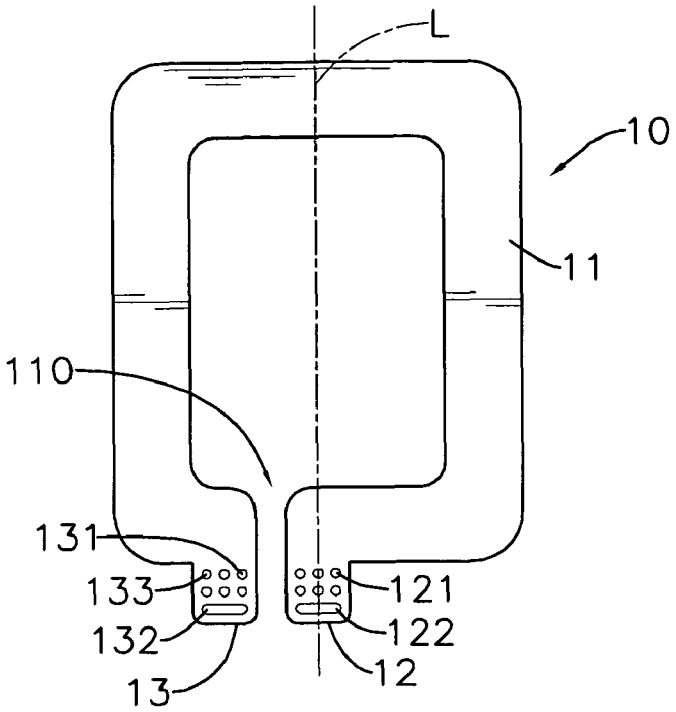
FIG. 2 A is a top plan view of a first ring of the multilayer winding in FIG. 1.
FIG. 2B is a bottom plan view of the first ring of the multilayer winding in FIG. 1.
Figure 2B:
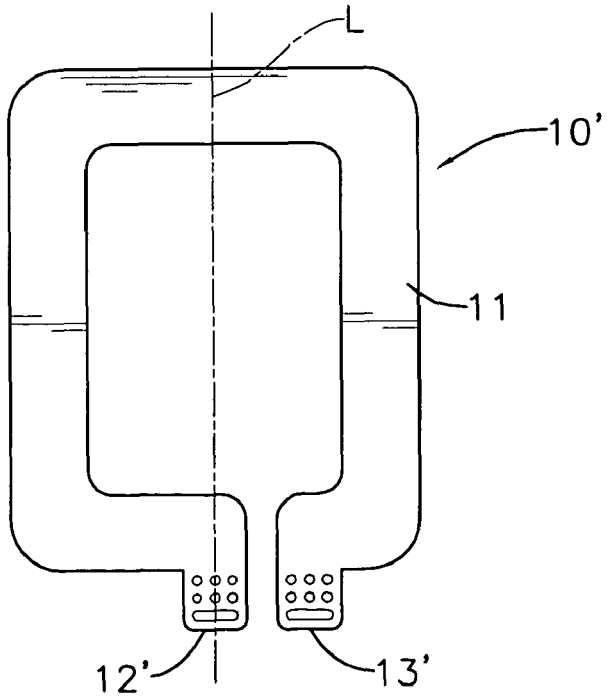

With further reference to FIGS. 2A and 2B, the upper and lower first metal rings (10, 10') are shown and are identical. Each first metal ring (10, 10') has a center-shift opening (110), a central mount (12, 12'), an askew mount (13, 13'), a top and bottom faces (not numbered), and defines a center line (L). The center-shift opening (110) is formed on one position of the first metal ring (10, 10') to be distant from the center line (L). The central and askew mounts (13, 12) (13', 12') are parallelly and outwardly extended from the center-shift opening (110) and the central mount (12) is located on the center line (L). Since the upper and lower first metal rings (10, 10') are identical, the top face of the lower first metal ring (10) faces to the bottom face of the upper first metal ring (10'). The central mount (12') of the lower first metal ring (10') aligns with the central mount (12) of the upper second metal ring (10). Therefore, the askew mounts (13, 13') of the upper and lower first metal rings (10, 10') are respectively located next to left and right sides of the central mounts (12).

Figure 3:
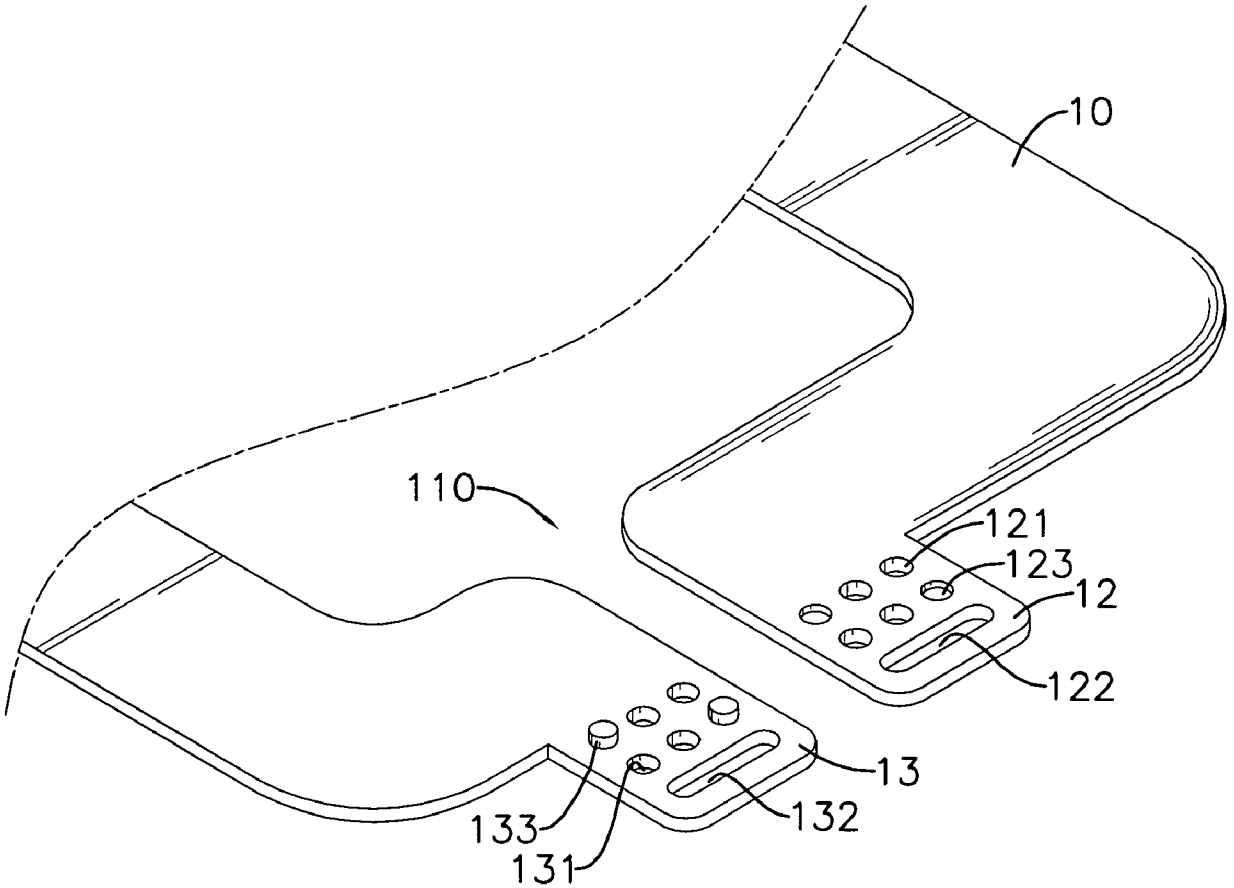
FIG. 3 is an enlarged perspective view of the first ring of the multilayer winding in FIG. 1.

With further to FIG. 3, each first metal ring (10) further has multiple through holes (131, 121), protrusions (133, 123) and multiple slots (132, 121') formed on the first and central mounts (13, 12). In the first embodiment, four through holes (131) and two protrusions (133) are formed on the askew mounts (13) and arranged in two lines. One protrusion (133) is first of the line and the other protrusion (133) is last of the other line. One slot (132) is defined through the askew mount (13) and close to a free edge and parallel with the two lines. The central mount (12) has the same through holes (121), the protrusions (123) and the slot (121') that the askew mount (13) has, but the two protrusions (123) are formed downwardly from a bottom of the central mount (12). The two protrusions (133) are formed upwardly from a top of the askew mount (13).

When the two adjacent first metal rings (10, 10') and one insulation layer (30) are stacked to build one sub-stack, the protrusions (123) of the central mount (12') of the lower first metal ring (10') are inserted into the through holes (121) of the central mount (12) of the upper first metal ring (10).

Figure 4A:
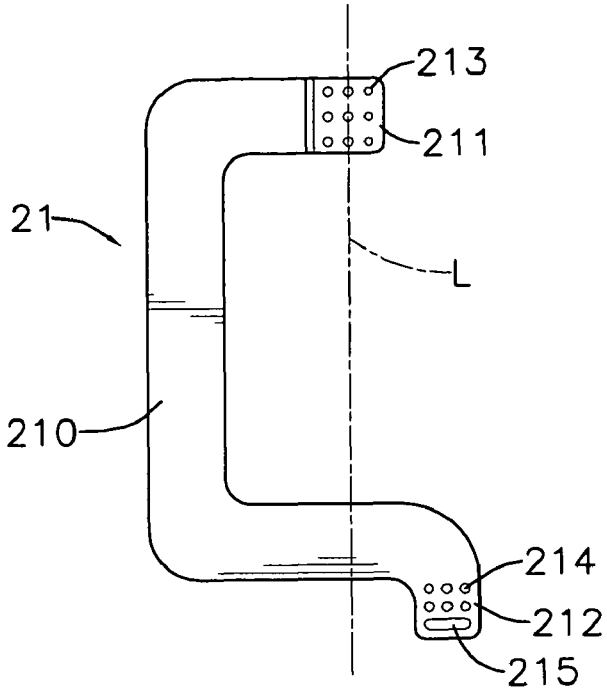
FIG. 4A is a top plan view of a first half ring of a second ring of the multilayer winding in FIG. 1.
Figure 4B:
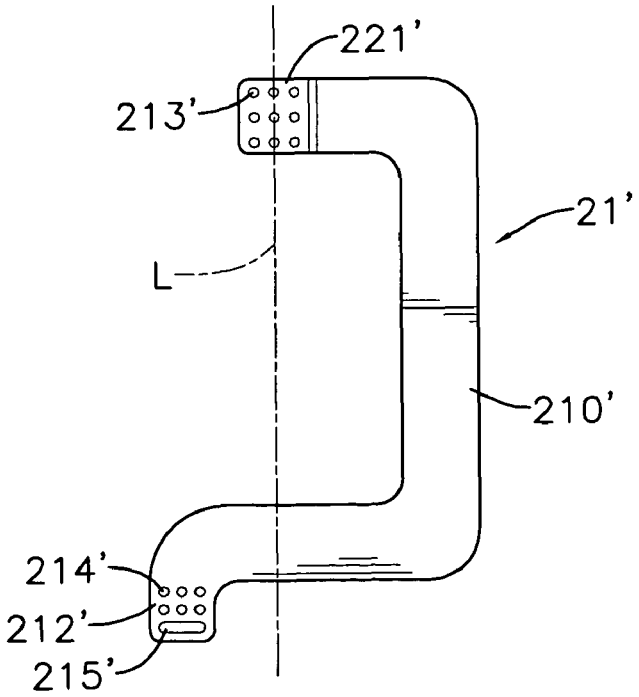
FIG. 4B is a top plan view of a second half ring of the second ring of the multilayer winding in FIG. 1.

With reference to FIGS. 1A, 4A and 4B, each second metal ring (20) has two half rings (21, 21'), an insulation layer (30) and a center line (L). The two half rings (21, 21') are identical, and each half ring (21, 21') has a top surface (not numbered), a bottom surface (not numbered), a long side (210, 210'), a first and second short sides (not numbered), an interconnecting mount (211, 211') and an askew mount (212, 212'). Two ends of the long side (210, 210') are respectively integrated with one end of the first and second short sides. The other end of the first short side is further integrated with the interconnecting mount (211, 211'). The askew mount (212, 212') is extended outwardly from other end of the second short side. The interconnecting mount (211, 211') is located on the center line (L), and the second sort side crosses the center line (L), so the second short side is longer than the first short side.

Figure 5:
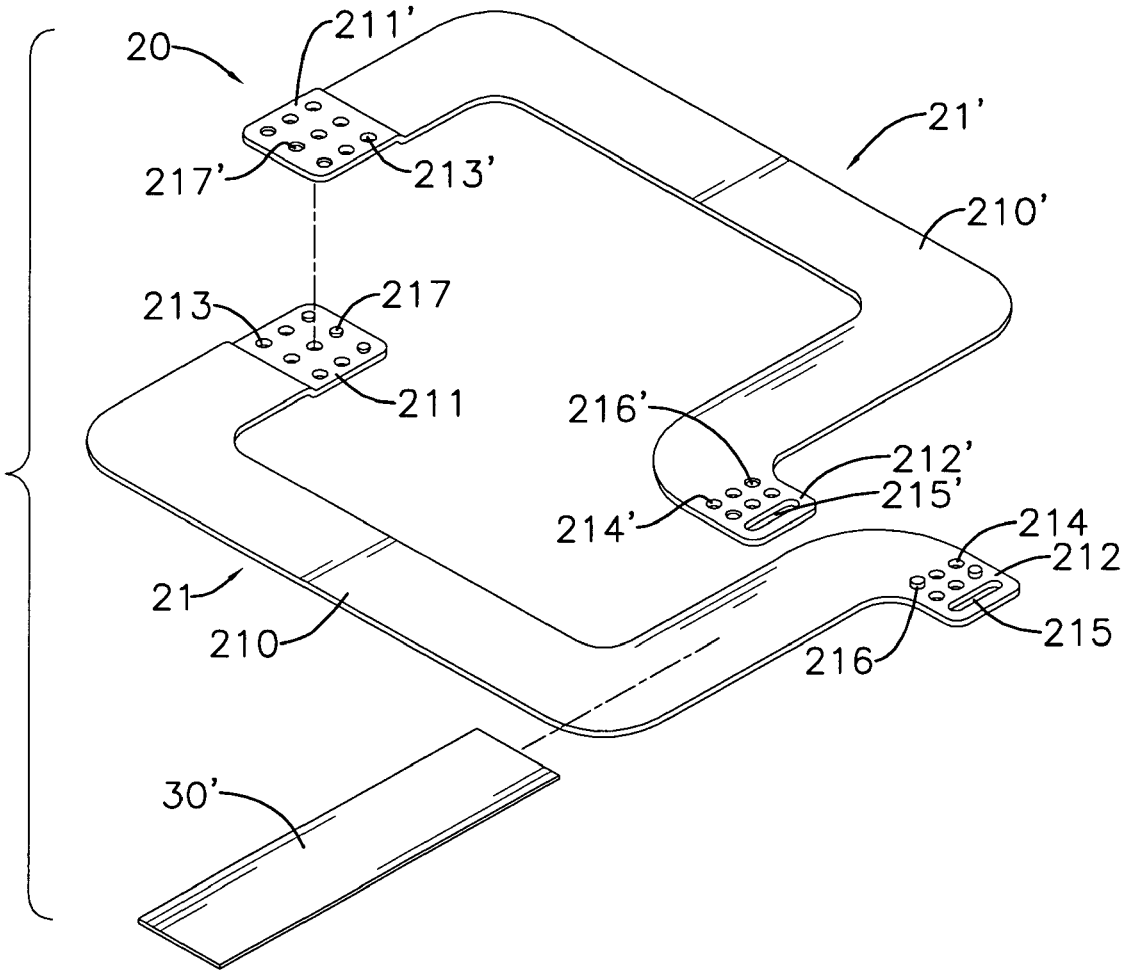
FIG. 5 is an exploded perspective view of the second ring of the multilayer winding in FIG. 1.
Figure 6:
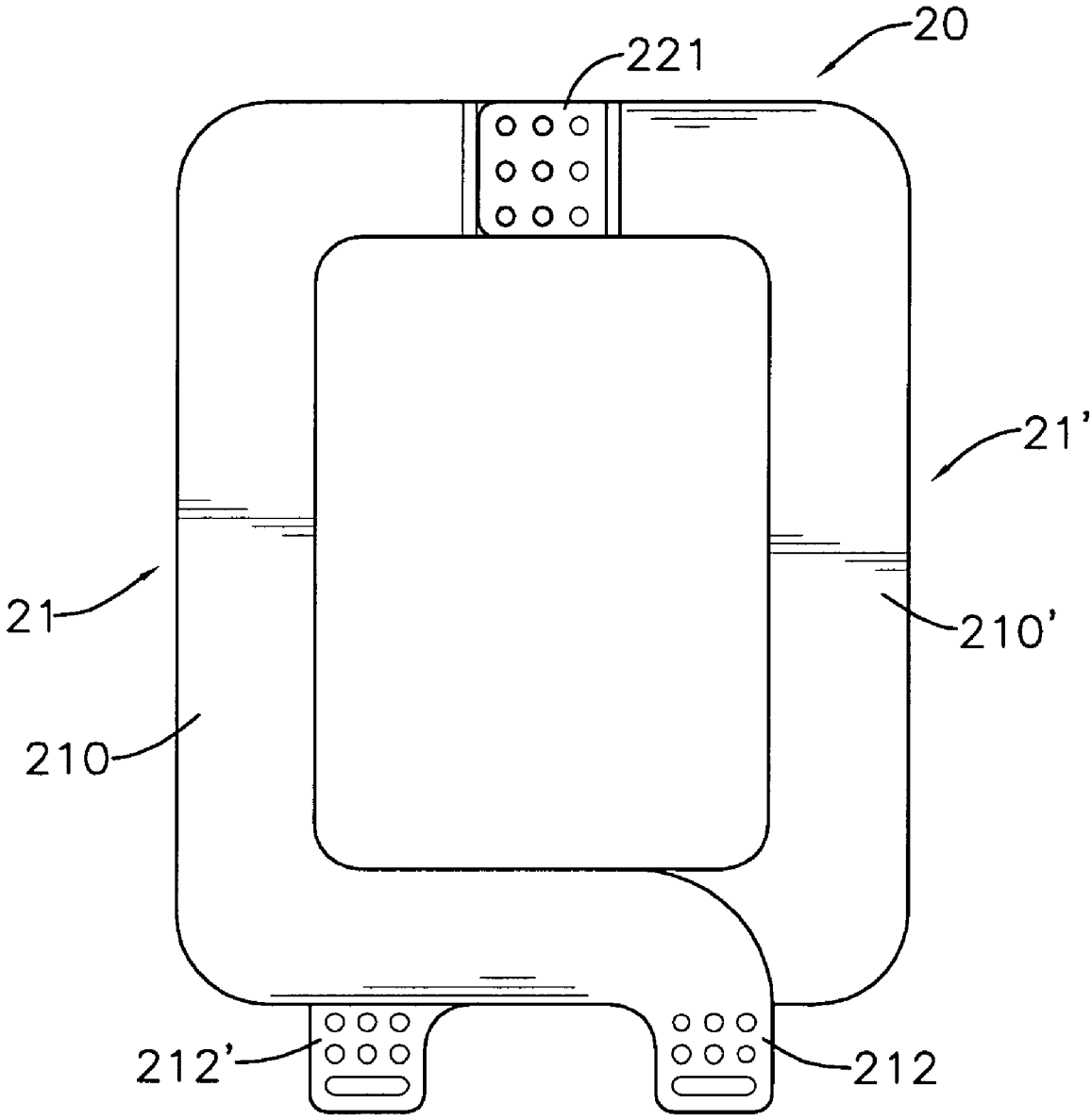
FIG. 6 is a top view of the second ring of the multilayer winding in FIG. 1.
Figure 7:
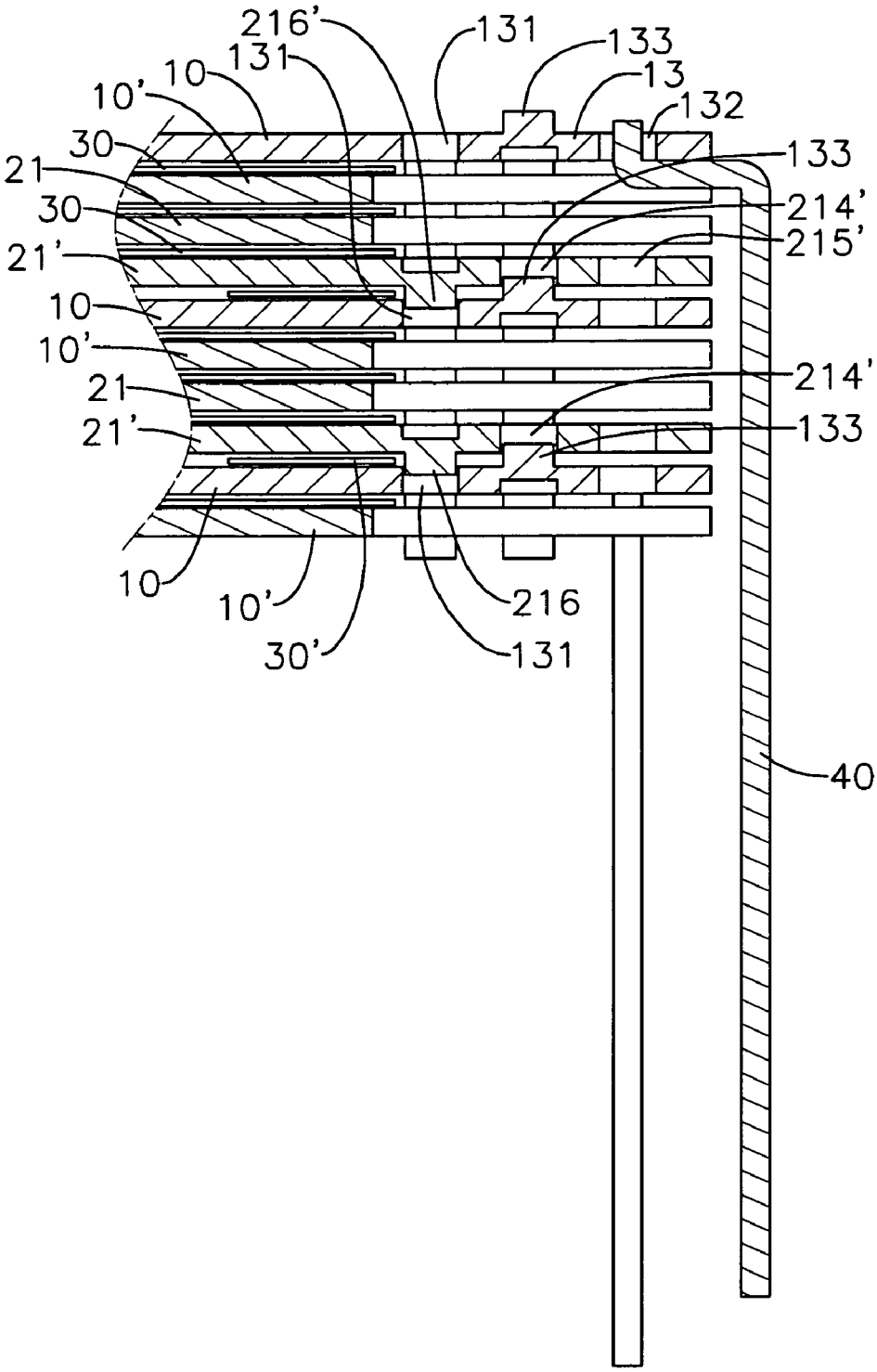
FIG. 7 is a cross sectional view of the multilayer winding in FIG. 1.

With further reference to FIGS. 5 and 7, to assemble the second metal ring (20), the two half rings (21, 21') are stacked and a second insulating layer (30') is interposed between the two half rings (21, 21'). The upper surface of the lower half ring (21) faces to the upper surface of the upper half ring (21'). Therefore, the two interconnecting mounts (211, 211') of the two half rings (21, 21') are overlapped and further connected together. The two second short sides of the upper and lower half rings (21, 21') partially intersect through the second insulating layer (30'). The two askew mounts (212, 212') of the upper and lower half rings (21, 21') protrude from the second metal ring (20), and respectively align with the askew mounts (13, 13') of the upper and lower first metal rings (10, 10') after the second metal ring (20) is interposed between the two adjacent sub-stacks.

Each half ring (21, 21') further has multiple through holes (213, 223) (214, 224), multiple protrusions (217, 227) (216, 226) and one slot (215, 225). The through holes (213, 223) and multiple protrusions (217, 227) are respectively formed on the interconnecting mount (211, 221). The slots (215, 225) are respectively formed on the askew mounts (212, 221') of the lower and upper half rings (21, 21'). In this embodiment, six through holes (213, 223) are defined through the interconnecting mount (211, 221) and arranged in two columns. Three protrusions (217, 227) are formed on a top of the interconnecting mount (211, 221) and arranged to one column and close to a free edge of the interconnecting mount (211, 221). The askew mount (212, 221') has the same through holes (214, 214') and the protrusions (216, 216') and slot (215, 215) that the askew mount (13) of the first metal ring (10) of each sub-stack has. Since the top surface of the upper half ring (21') faces to the top surface of the lower half ring (21), the two protrusions (216) on the askew mount (212') of the upper half ring (21') protrude downwardly and the two protrusions (216) on the askew mount (212) of the lower half ring (21) protrude upwardly.

When two interconnecting mounts (211, 211') of the upper and lower half rings (21, 21') are connected, the three protrusions (217') of the upper half ring (21') are inserted into the corresponding three through holes (213) of the lower half ring (21). The three protrusions (217) of the lower half ring (21) are inserted into the corresponding three through holes (213') of the upper half ring (21'). Since one insulation layer (30) is interposed between the upper and lower half rings (10) and has a fixed thickness, a gap between the other column of three through holes (213') of the upper half ring (21') and the other column of three through holes (213) of the lower half ring (21) is large enough for soldering. Therefore, the upper and lower half rings (21, 21') are connected securely.

With reference to FIGS. 1, 5 and 7, when one second metal ring (20) is connected to the two adjacent sub-stacks through the insulation layers (30), the protrusions (213') of the askew mount (211') of the upper half ring (21') of the second metal ring (20) are inserted in the corresponding through holes (131) of the askew mount (13) of the upper first metal ring (10) of the lower sub-stack. The protrusions (133) of the askew mount (13) of the upper first metal ring (10) of the lower sub-stack are inserted in the corresponding through holes (213') of the askew mount (211') of the upper half ring (21'). The protrusions (216) of the askew mount (212) of the lower half ring (21) are inserted in the corresponding through holes (131) of the askew mount (13) of the lower first metal ring (10') of the upper sub-stack. The protrusions (133) of the askew mount (13) of the lower first metal ring (10') of the upper sub-stack are inserted in the corresponding through holes (214) of the askew mount (212) of the lower half ring (21) of the second metal ring (20). The askew mount (13) of the upper first metal ring (10) of the top sub-stack of the stack body (1) is further connected to the first pin (40). The askew mount (13) of the lower first metal ring (21) of the bottom sub-stack of the stack body (1) is further connected to the second pin (40). The first and second pins (40) are external terminals of the multilayer electromagnetic component and used to solder on a printed circuit (PCB).

Figure 8:
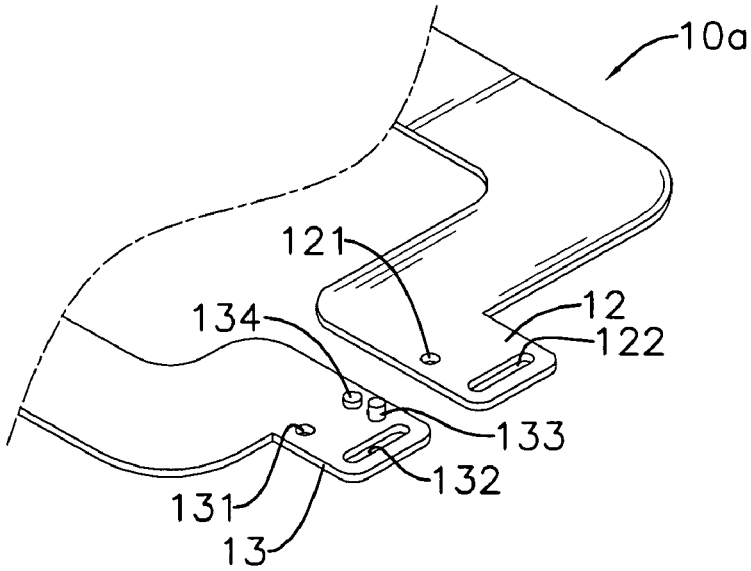
FIG. 8 is another enlarged perspective view of the first ring of the multilayer winding in FIG. 1.
Figure 9:
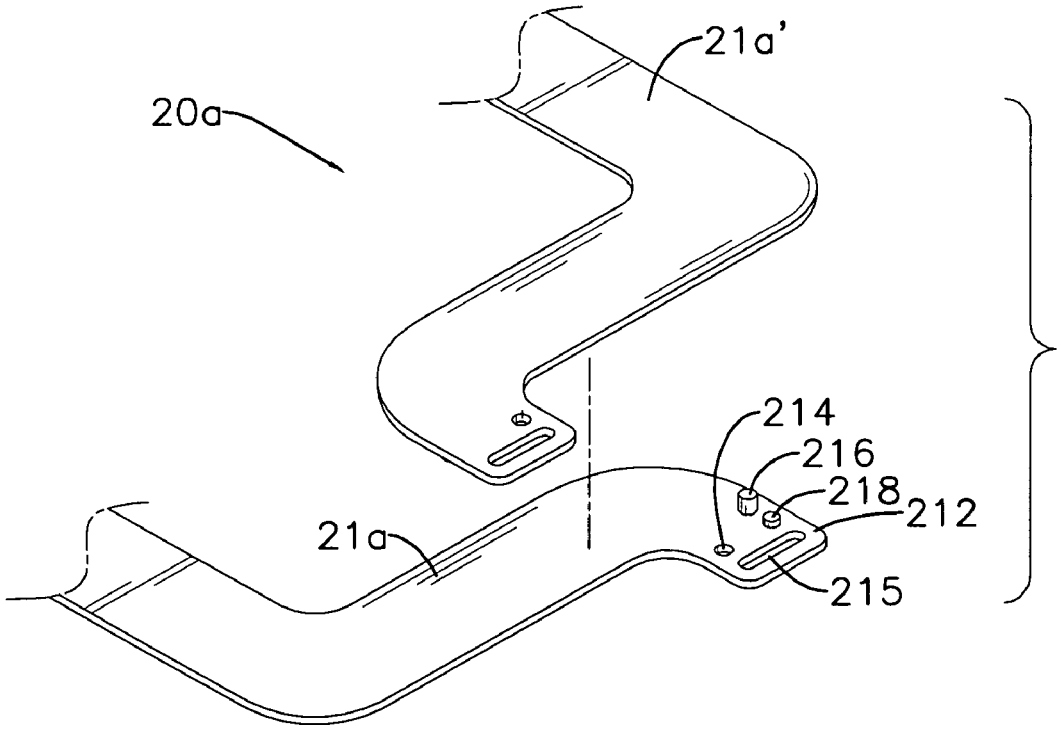
FIG. 9 is an exploded perspective view of a third embodiment of rings of a multilayer winding in accordance with the present invention.

With reference to FIG. 8, another first metal ring (10*a*) is similar to the first metal ring mentioned above. The askew mount (13) has one through hole (131), one protrusion (133) and one slot (132) and further has a spacer (134) next to the protrusion (133). The through hole (131) and the protrusion (133) are formed at two diagonal locations on the top of the askew mount (13). The protrusion (133) is higher than the spacer (134). The central mount (12) also has a through hole (121), a protrusion (not shown), a slot (122) and a spacer (not shown) that the askew mount (13) has, but the protrusion and the spacer of the central mount (12) are extended from the bottom of the central mount (12). With further reference to FIG. 9, another second metal ring (20*a*) is shown. The askew mount (212) of each half ring (21*a*) has a through hole (214), a protrusion (216), a slot (215) and a spacer (218) that the askew mount (13) of the first metal ring (10*a*) has.

Figure 10:
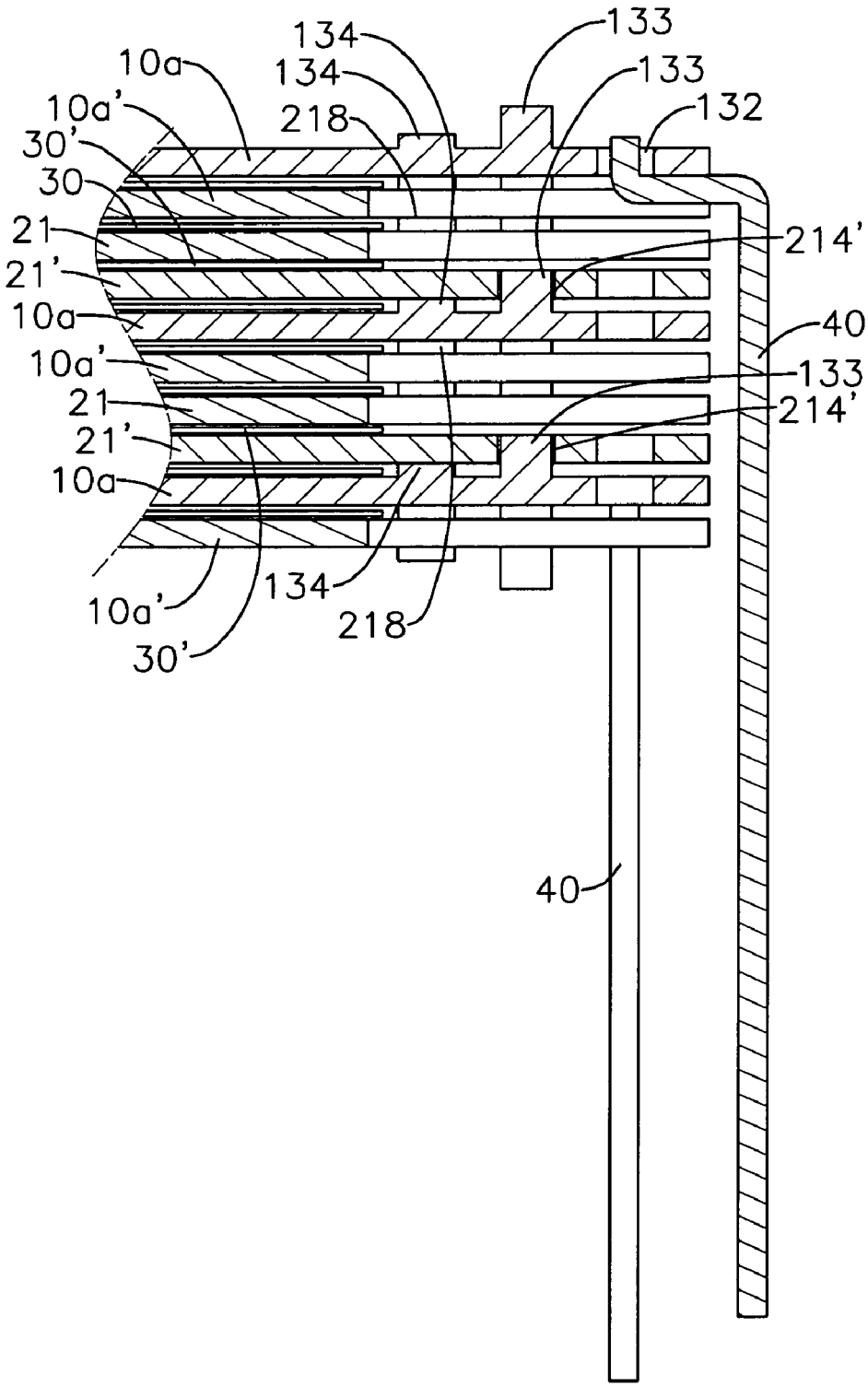
FIG. 10 is a cross sectional view in partial of the third embodiment of a multilayer winding in accordance with the present invention.

With further reference to FIG. 10, when the second metal ring (20*a*) is interposed in between the upper and lower sub-stacks, the protrusions (not shown) of the second metal ring (20*a*) are respectively inserted to the corresponding through holes (131) of the askew mounts (13) of the upper and lower first metal rings (10, 10'). The through holes (214) of the second metal ring (20*a*) are respectively received in the corresponding protrusions (133) of the askew mounts (13) of the upper and lower first metal rings (13). Since the protrusion (216) is higher than the spacer (218), the spacers (218) of the second metal ring (20*a*) separate the second metal ring (20*a*) and the upper and lower first metal rings (10*a*, 10') of the adjacent sub-stacks. Therefore, a soldering gap between the askew mount (212) of the second metal ring (20*a*) and the askew mount (13) of the first metal ring (10*a*, 10*a*') is further increased.

Figure 11:
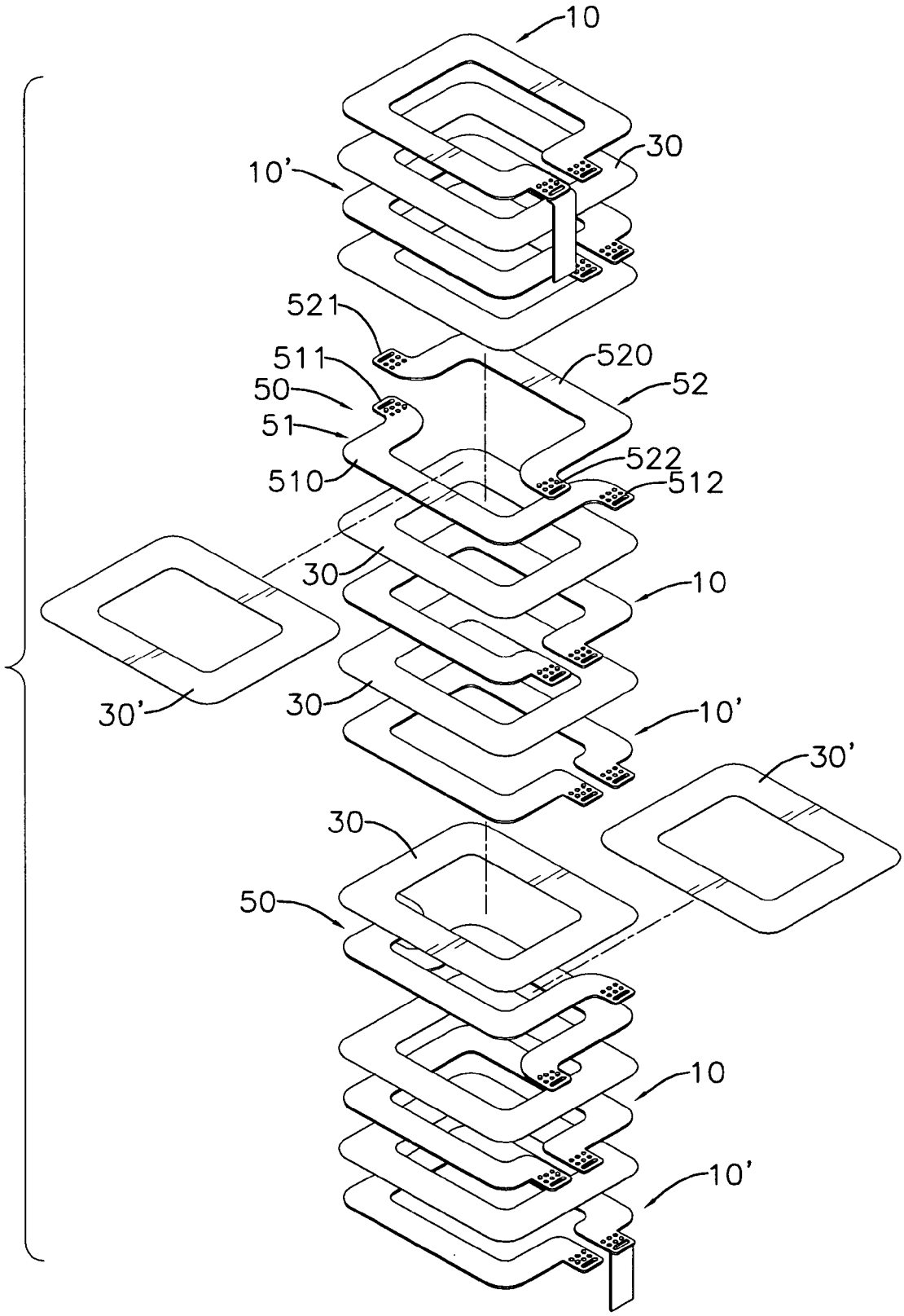
FIG. 11 is an exploded perspective view of a fourth embodiment of a multilayer winding in accordance with the present invention.

With reference to FIG. 11, a second embodiment of a multilayer winding for a central-tapped transformer is similar to the first embodiment but the second metal ring (50) is different. In addition the multilayer electromagnetic component further has a trapping terminal.

The second embodiment of the second metal ring (50) has two half rings (51, 52) and each half ring (51, 52) has a long side (510, 520), a first and second short sides (not numbered), an interconnecting mount (511, 521) and an askew mount (512, 521'). The two ends of the long side (510, 520) are respectively integrated with two ends of the first and second short sides. The interconnecting mount (511, 521) is extended outwardly from the free end of the first short side. The askew mount (512, 521') is extended outwardly from the free end of the second short side. When the second metal ring (50) is assembled by connecting the two half rings (51, 52), the two interconnecting mounts (521, 521') are outwardly extended from the second metal ring (50) and opposite to the askew mounts (512, 521'). Therefore, the interconnecting mount (511, 521) is as the trapping terminal.

Figure 12:
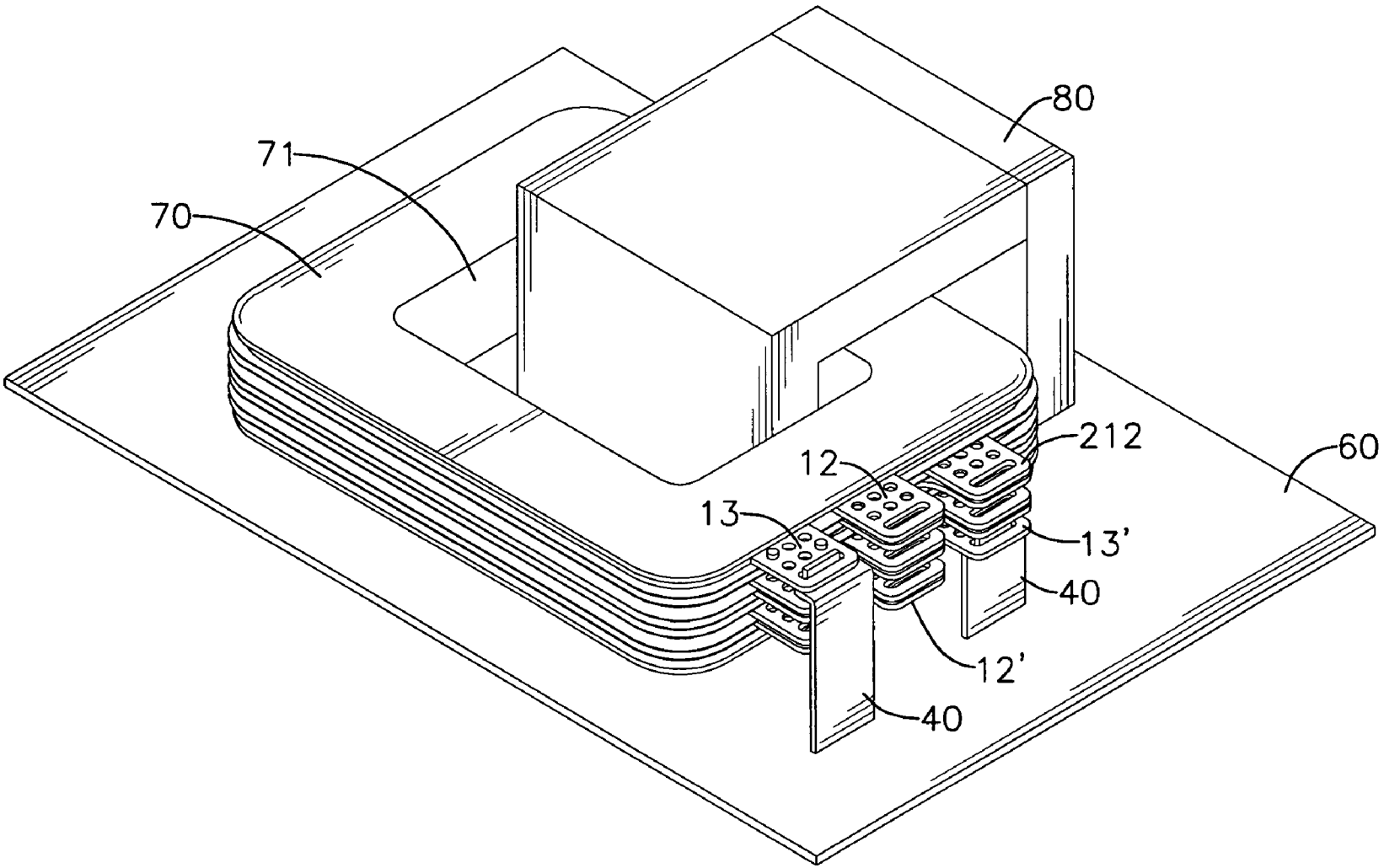
FIG. 12 is a perspective view the multilayer electromagnetic component in accordance with the present invention mounted around a core.
Figure 13:
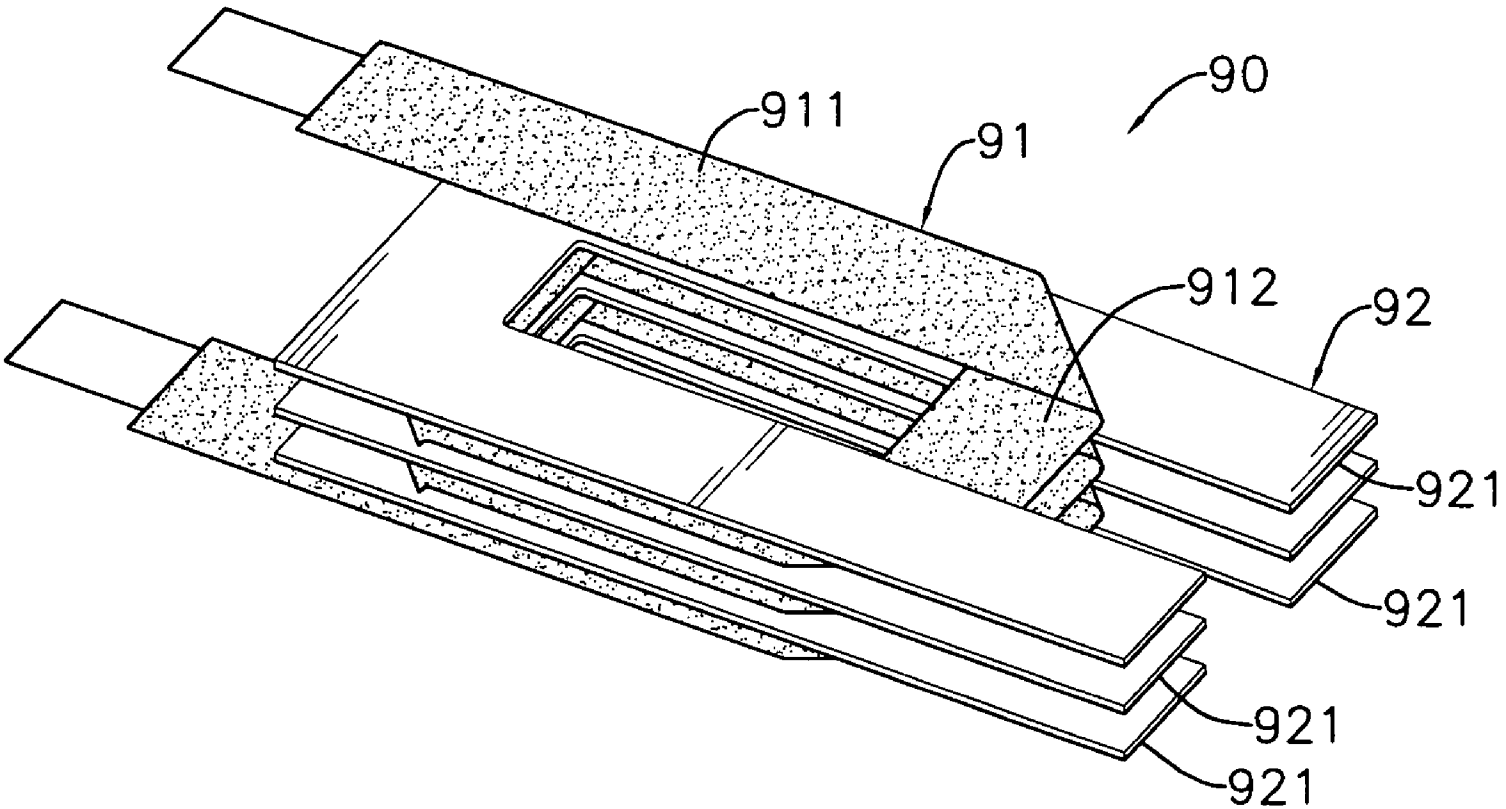
FIG. 13 PRIOR ART
FIG. 13 is a perspective view of another conventional multilayer electromagnetic component in accordance with the prior art.
Figure 14:
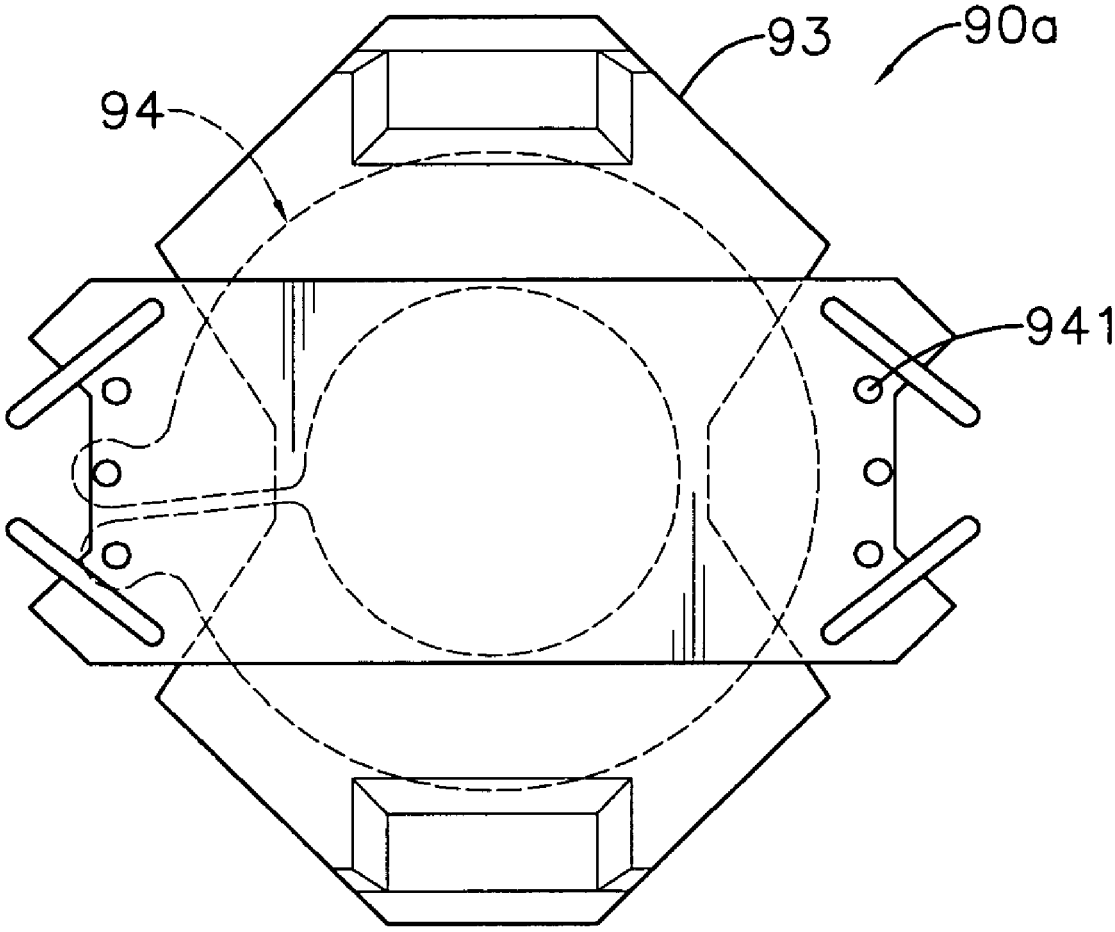
FIG. 14 PRIOR ART
FIG. 14 is top plan view of a conventional multilayer electromagnetic component in accordance with the prior art.
Figure 15A:
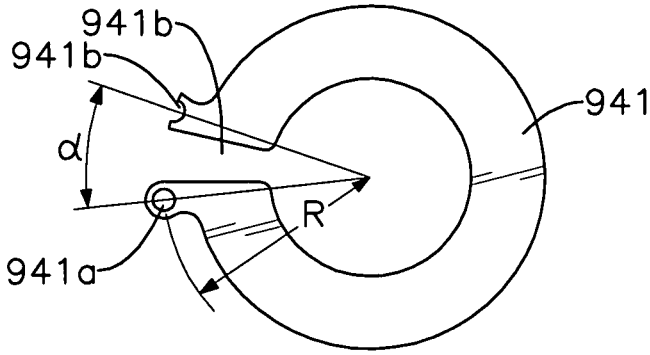
FIG. 15A PRIOR ART
FIGS. 15 A to 15C are top plan views of a winding in FIG. 14.
Figure 15B:
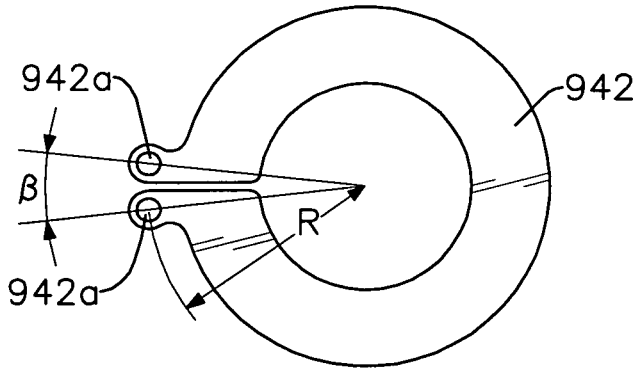
FIG. 15B PRIOR ART
Figure 15C:
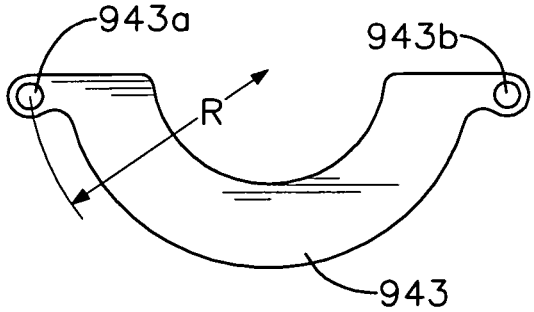
FIG. 15C PRIOR ART

With reference to FIG. 12, a choke is shown and has a PCB (60), a bobbin (70, 71), a multilayer winding (not numbered) and an iron core (80). The bobbin (70, 71) is rectangular and the multilayer winding mentioned above is fixed outside the bobbin (70, 71). The iron core (80) is passed through the bobbin (70, 71). The pins (40) of the multilayer winding are connected to the PCB (60).

Based on the foregoing description, the multilayer winding only uses two forms of the metal rings, since the upper and lower first metal ring of one sub-stack are identical, and the upper half ring and lower half ring of one second metal ring are identical. To assemble the sub-stack, two first metal rings are prepared, one of the first metal ring is inverted and then an inverse first metal ring is disposed upon the other first metal ring. To assemble the second metal ring, two half rings are prepared, one of the two half rings is reversed and then the inverse half ring and the other half ring are intersected. To assemble the multilayer winding, multiple sub-stacks are stacked and each second metal ring is inserted between two corresponding sub-stacks.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A multilayer winding comprising a stack body and multiple external pins connected to the stack body, wherein the stack body comprises:

multiple sub-stacks stacked to each other, wherein each sub-stack has two first metal rings and a first insulation layer interposed between the two first metal rings, wherein each first metal ring has:

a first center line;

a center-shift opening formed on one position of the first metal ring to be distant from the first center line;

to first and central mounts outwardly extended from the center-shift opening, wherein the central mount is located on the center line; and top and bottom faces, wherein one of the two first metal rings is stacked upon the other first metal ring, so the sub-stack has an upper first metal ring and a lower first metal ring, wherein the top face of the upper first metal ring faces to the top of the lower first metal ring;

at least one second metal rings, each of which is interposed between two corresponding adjacent sub-stacks, wherein each second metal ring has:

a second center line aligned to the first center line;

two half rings each of which has a top surface, a bottom surface, two ends, an interconnecting mount and an askew mount, wherein one of the two ends is integrated with the interconnecting mount, and the askew mount is extended outwardly from the other end, wherein the interconnecting side is located on the center line, and the askew mount crosses the second center line; and a second insulation layer interposed between the two half rings; wherein one of the two half rings intersect, so the sub-stack has an upper half ring and a lower half ring, wherein the top surface of the upper half ring faces to the top of the lower half ring; and multiple third insulation layers, each of which is interposed between the sub-stack and the second metal ring.

2. The multilayer winding as claimed in claim 1, wherein each first metal ring is rectangular; and each half ring further comprising a long side, a first side and a short side, wherein two ends of the long side are respectively integrated with ends of the first and second short sides, and the other end of the first short side is integrated with the interconnecting mount, and the askew mount is extended outwardly from the other end of the second short side, wherein the second short side is longer than the first short side.

3. The multilayer winding as claimed in claim 2, wherein the askew mount of each first metal ring further comprises a top, multiple through holes and at least one protrusion, wherein the at least one protrusion protrudes from the top of the askew mount;

the central mount of each first metal ring further comprises a bottom, multiple through holes and at least one protrusion, wherein the at least one protrusion protrudes from the bottom of the askew mount;

the interconnecting mount of each half ring further comprises a top, multiple through holes and at least one protrusion protruding from the top of the interconnecting mount; and the askew mount of each half ring further comprises a top, multiple through holes and at least one protrusion protruding from the top of the askew mount.

4. The multilayer winding as claimed in claim 3, wherein the askew mount of each first metal ring further comprises at least one spacer protruding from the top of the askew mount and shorter than the at least one protrusion on the top of the askew mount;

the central mount of each first metal ring further comprises at least one spacer protruding from the bottom of the central mount and shorter than the at least one protrusion on the bottom of the central mount; and the askew mount of each half ring further comprises at least one spacer protruding from the top of the askew mount and shorter than the at least one protrusion on the top of the askew mount.

5. The multilayer winding as claimed in claim 4, wherein the askew mount of each first metal ring further comprises an edge and a slot formed in the edge of the askew mount;

the central mount of each first metal ring further comprises an edge and a slot formed in the edge of the central mount; and the askew mount of each half ring further comprises an edge and a slot formed in the edge of the askew mount.

6. The multilayer winding as claimed in claim 5, wherein the interconnecting mount is outwardly extended from the other end of the first short side and opposite to the askew mount extended from the other end of the second short side.

7. A compact electromagnetic component comprising a bobbin, a multilayer winding mounted outside of the bobbin and iron core mounted around the bobbin and the multilayer winding, wherein the multilayer winding comprises a stack body and multiple external pins connected to the stack body, wherein the stack body comprises:

multiple sub-stacks stacked to each other, wherein each sub-stack has two first metal rings and a first insulation layer interposed between the two first metal rings, wherein each first metal ring has:

a first center line;

a center-shift opening formed on one position of the first metal ring to be distant from the first center line;

first and central mounts outwardly extended from the center-shift opening, wherein the central mount is located on the center line; and top and bottom faces, wherein one of the two first metal rings is stacked upon the other first metal ring, so the sub-stack has an upper first metal ring and a lower first metal ring, wherein the top face of the upper first metal ring faces to the top of the lower first metal ring;

at least one second metal rings each of which is interposed between two corresponding adjacent sub-stacks, wherein each second metal ring has:

a second center line aligned to the first center line;

two half rings each of which has a top surface, a bottom surface, two ends, an interconnecting mount and an askew mount, wherein one of the two ends is integrated with the interconnecting mount, and the askew mount is extended outwardly from the other end, wherein the interconnecting side is located on the center line, and the askew mount crosses the second center line; and a second insulation layer interposed in between the two half rings; wherein one of the two half rings are intersected, so the sub-stack has an upper half ring and a lower half ring, wherein the top surface of the upper half ring faces to the top of the lower half ring; and multiple third insulation layers, each of which is interposed between the sub-stack and the second metal ring.

8. The compact electromagnetic component as claimed in claim 7, wherein each first metal ring is rectangular; and each half ring further comprises a long side, a first side and a short side, wherein two ends of the long side are respectively integrated with two ends of the first and second short sides, and the other end of the first short side is integrated with the interconnecting mount, and the askew mount is extended outwardly from the other end of the second short side, wherein the second short side is longer than the first short side.

9. The compact electromagnetic component as claimed in claim 8, wherein the askew mount of each first metal ring further comprises a top, multiple through holes and at least one protrusion, wherein the at least one protrusion protrudes from the top of the askew mount;

the central mount of each first metal ring further comprises a bottom, multiple through holes and at least one protrusion, wherein the at least one protrusion protrudes from the bottom of the askew mount;

the interconnecting mount of each half ring further comprises a top, multiple through holes and at least one protrusion protruding from the top of the interconnecting mount; and the askew mount of each half ring further comprises a top, multiple through holes and at least one protrusion protruding from the top of the askew mount.

10. The compact electromagnetic component as claimed in claim 9, wherein the askew mount of each first metal ring further comprises at least one spacer protruding from the top of the askew mount and shorter than the at least one protrusion on the top of the askew mount;

the central mount of each first metal ring further comprises at least one spacer protruding from the bottom of the central mount and shorter than the at least one protrusion on the bottom of the central mount; and the askew mount of each half ring further comprises at least one spacer protruding from the top of the askew mount and shorter than the at least one protrusion on the top of the askew mount.

11. The compact electromagnetic component as claimed in claim 10, wherein the askew mount of each first metal ring further comprises an edge and a slot formed in the edge of the askew mount;

the central mount of each first metal ring further comprises an edge and a slot formed in the edge of the central mount; and the askew mount of each half ring further comprises an edge and a slot formed in the edge of the askew mount.

12. The compact electromagnetic component as claimed in claim 11, wherein the interconnecting mount is outwardly extended from the other end of the first short side and opposite to the askew mount extended from the other end of the second short side.

13. A multilayer winding comprising a stack body and multiple external pins connected to the stack body, wherein the stack body comprises:

a sub-stack having two first metal rings and a first insulation layer interposed between the two first metal rings, wherein each first metal ring has:

a first center line;

a center-shift opening formed on one position of the first metal ring to be distant from the first center line;

first and central mounts outwardly extended from the center-shift opening, wherein the central mount is located on the center line; and top and bottom faces, wherein one of the two first metal rings is stacked upon the other first metal ring, so the sub-stack has an upper first metal ring and a lower first metal ring, wherein the top face of the upper first metal ring faces to the top of the lower first metal ring;

a second metal ring stacked on the sub-stack and having:

a second center line aligned to the first center line;

two half rings each of which has a top surface, a bottom surface, two ends, an interconnecting mount and an askew mount, wherein one of the two ends is integrated with the interconnecting mount, and the askew mount is extended outwardly from the other end, wherein the interconnecting side is located on the center line, and the askew mount crosses the second center line; and a second insulation layer interposed between the two half rings; wherein one of the two half rings intersect, so the sub-stack has an upper half ring and a lower half ring, wherein the top surface of the upper half ring faces to the top of the lower half ring; and multiple third insulation layers, each of which is interposed between the sub-stack and the second metal ring.

14. The multilayer winding as claimed in claim 13, wherein each first metal ring is rectangular; and each half ring further comprising a long side, a first side and a short side, wherein two ends of the long side are respectively integrated with ends of the first and second short sides, and the other end of the first short side is integrated with the interconnecting mount, and the askew mount is extended outwardly from the other end of the second short side, wherein the second short side is longer than the first short side.

15. The multilayer winding as claimed in claim 14, wherein the askew mount of each first metal ring further comprises a top, multiple through holes and at least one protrusion, wherein the at least one protrusion protrudes from the top of the askew mount;

the central mount of each first metal ring further comprises a bottom, multiple through holes and at least one protrusion, wherein the at least one protrusion protrudes from the bottom of the askew mount;

the interconnecting mount of each half ring further comprises a top, multiple through holes and at least one protrusion protruding from the top of the interconnecting mount; and the askew mount of each half ring further comprises a top, multiple through holes and at least one protrusion protruding from the top of the askew mount.

16. The multilayer winding as claimed in claim 15, wherein the askew mount of each first metal ring further comprises at least one spacer protruding from the top of the askew mount and shorter than the at least one protrusion on the top of the askew mount;

the central mount of each first metal ring further comprises at least one spacer protruding from the bottom of the central mount and shorter than the at least one protrusion on the bottom of the central mount; and the askew mount of each half ring further comprises at least one spacer protruding from the top of the askew mount and shorter than the at least one protrusion on the top of the askew mount.

17. The multilayer winding as claimed in claim 16, wherein the askew mount of each first metal ring further comprises an edge and a slot formed in the edge of the askew mount;

the central mount of each first metal ring further comprises an edge and a slot formed in the edge of the central mount; and the askew mount of each half ring further comprises an edge and a slot formed in the edge of the askew mount.

18. The multilayer winding as claimed in claim 17, wherein the interconnecting mount is outwardly extended from the other end of the first short side and opposite to the askew mount extended from the other end of the second short side.

* * * * *